US012392577B1

(12) United States Patent
Wei

(10) Patent No.: US 12,392,577 B1
(45) Date of Patent: Aug. 19, 2025

(54) SINGLE-SHOT/REPEATING SWITCHING DEVICE OF TOY GUN

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 18/771,237

(22) Filed: Jul. 12, 2024

(51) Int. Cl.
*F41B 11/723* (2013.01)
*F41B 11/89* (2013.01)

(52) U.S. Cl.
CPC ..... *F41B 11/723* (2013.01); *F41B 11/89* (2013.01)

(58) Field of Classification Search
CPC ..... F41B 11/54; F41B 11/723; F41B 11/89; F41A 17/38; F41A 17/64; F41A 17/72; F41A 17/80
See application file for complete search history.

(56) References Cited

U.S. PATENT DOCUMENTS 6,865,979 B1 * 3/2005 Vaid ..... F41A 11/00 89/144
10,132,592 B1 * 11/2018 Wei ..... F41A 19/02
10,712,120 B1 * 7/2020 Wei ..... F41B 11/89
10,852,098 B1 * 12/2020 Wei ..... F41C 23/16
2006/0191523 A1 * 8/2006 Paletz ..... F41B 11/642 124/67
2014/0096756 A1 * 4/2014 Wei ..... F41B 11/62 124/73
2018/0156566 A1 * 6/2018 Wei ..... F41B 11/70
2021/0389079 A1 * 12/2021 Wei ..... F41B 11/89
2023/0122428 A1 * 4/2023 Collins ..... F41B 11/70 124/80

* cited by examiner

*Primary Examiner* — Michael D David
(74) *Attorney, Agent, or Firm* — Chun-Ming Shih; HDLS IPR SERVICES

(57) ABSTRACT

A single-shot/repeating switching device includes a trigger, a trigger buffer, a release connecting plate, a positioning bar, and a safety blocker. The trigger includes a trigger body, a pushing block and an abutting end. The trigger buffer includes a moving block. The release connecting plate has an activating end and a fastened end. The single-shot/repeating switching button has a repeating opening. In a repeating mode, the trigger body is moved to make the abutting end enter the repeating opening, the pushing block pushes the safety blocker to move, and the moving block pushes the activating end to move upward to make the fastened end escape from locking to generate a first firing. The firing cylinder touches the fastened end to make the release connecting plate rotate about the positioning bar when returning. The activating end is pressed by the trigger buffer to slow down a subsequent repeating speed.

10 Claims, 17 Drawing Sheets

SINGLE-SHOT/REPEATING SWITCHING DEVICE OF TOY GUN

BACKGROUND

Technical Field

The disclosure relates to a toy gun, particularly to a single-shot/repeating switching device of a toy gun.

Related Art

Related-art toy guns usually use air pressure to serve as a main power source, which has cheap manufacturing costs. Also, under the joint development of the industry, the simulated appearances and the simulation of working modes have been provided, for example, magazine loading and shooting modes of single-shot or repeating.

The operation of firing mode uses the pull of the trigger. In the single-shot mode, the trigger will make a single release to the action elements in the bore of the gun to make it generate a single firing. The repeating mechanism usually uses a battery circuit to operate an electro-mechanic valve system or a mechanic working mode to obtain the frequency action of repeating firing. Advantages of the mechanic working mode are that no electricity is required and that malfunction of electronic devices caused by damp or damage caused by oscillation needs not to be considered. Also, the fixed stress of the mechanic working mode may make the accumulated pressure of the firing cylinder before firing have a higher threshold pressure value. Air pressure purely formed by using air pressure elements performs purely mechanic interactions between elements to accomplish multiple shooting modes, which has been widely adopted by the industry.

However, the related-art mechanic firing in the repeating mode still has the problem of stable shooting to be improved. The applicant improves the above technical issue.

SUMMARY

An object of the disclosure is to provide a single-shot/repeating switching device of a toy gun, which can achieve stable shooting in the repeating process.

To accomplish the above object, the disclosure provides a single-shot/repeating switching device of a toy gun, the toy gun includes a gun body and a firing cylinder, and the single-shot/repeating switching device includes a trigger, a trigger buffer, a release connecting plate, a positioning bar, a safety blocker and a single-shot/repeating switching button. The trigger includes a trigger body. The trigger body is pivoted to the gun body and has a pushing block and an abutting end. The trigger buffer is disposed on the trigger body and includes a moving block and an elastic body pushing the moving block. The release connecting plate has an activating end, a fastened end and a sliding trough between the activating end and the fastened end. The positioning bar passes the gun body and the sliding trough to position the release connecting plate. The safety blocker corresponds to the pushing block to be disposed on the gun body. The single-shot/repeating switching button is rotatably connected to the gun body and has a repeating opening. In a repeating mode, the trigger body is moved to make the abutting end enter the repeating opening, the pushing block pushes the safety blocker to move, and the moving block pushes the activating end of the release connecting plate to move upward to make the fastened end escape from locking of the firing cylinder to generate a first firing. The firing cylinder touches the fastened end to make the release connecting plate rotate about the positioning bar during a return process of the firing cylinder. The activating end is pressed by the trigger buffer to slow down a subsequent repeating speed.

In an embodiment, the activating end of the release connecting plate has a front end face, a lower arcuate surface and a lower tip, the front end face is formed on a front position of the activating end, the lower arcuate surface and the lower tip are formed at a lower position of the activating end, and the lower arcuate surface is between the front end face and the lower tip.

An embodiment further includes a pushing spring, the pushing spring is disposed between the release connecting plate and the gun body and elastically pushes the release connecting plate to act.

In an embodiment, the sliding trough of the release connecting plate is between the activating end and the fastened end.

In an embodiment, the trigger body is disposed with a receiving trough, and the trigger buffer is disposed in the receiving trough.

In an embodiment, the trigger further includes a first shaft, the first shaft is connected to the trigger body and formed on an end of the moving block, which is away from the elastic body.

In an embodiment, the trigger further includes a second shaft, the moving block is disposed with a limiting trough, and the second shaft passes the trigger body and the limiting trough to make a travel of the moving block limited by the second shaft.

In an embodiment, the trigger further includes a returning spring, and the returning spring is clamped between the gun body and the trigger body which is away from the abutting end.

In an embodiment, the safety blocker includes a rod and a compression spring, the rod comprises a pushing slope pushed by the pushing block, and the compression spring is connected to the rod to provide a returning force.

In an embodiment, the single-shot/repeating switching button is further disposed with a single-shot opening, the repeating opening is parallel to a central line of the single-shot/repeating switching button, and the single-shot opening is perpendicular to the central line of the single-shot/repeating switching button.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
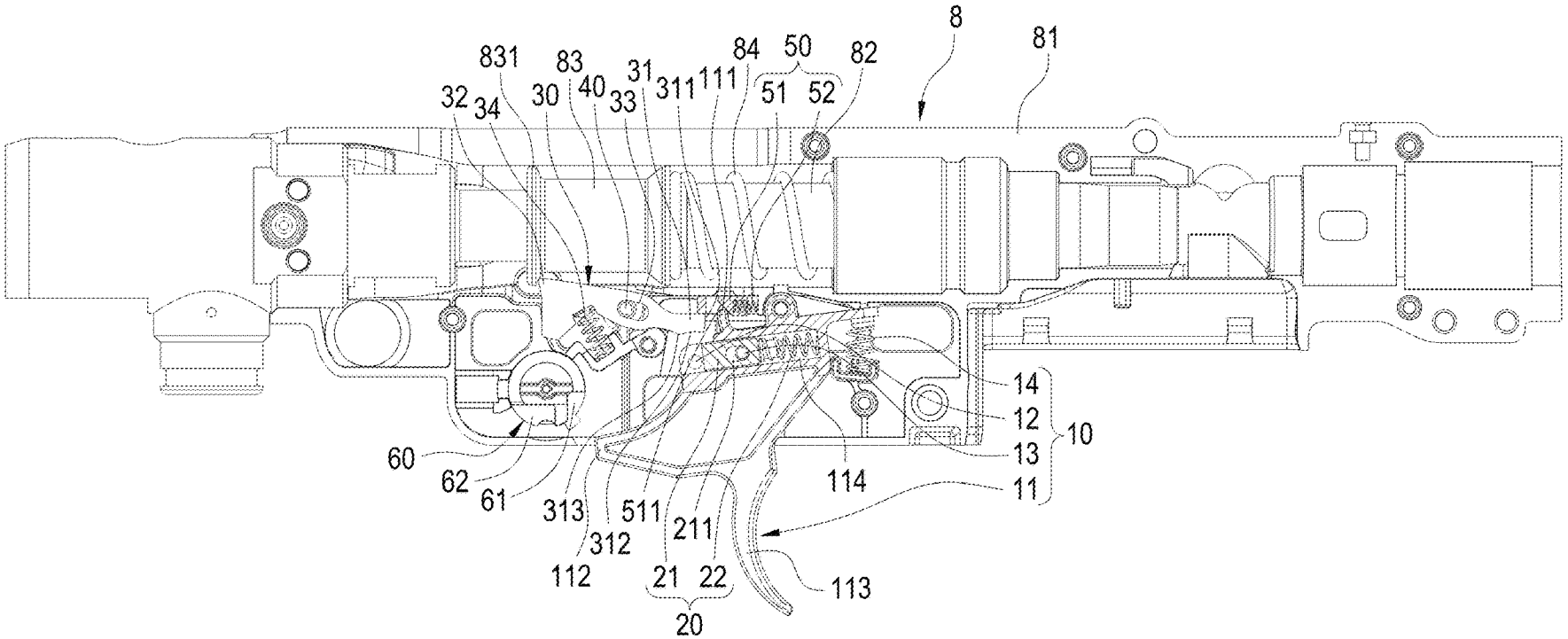
FIG. 1 is an assembled cross-sectional view of the single-shot/repeating switching device of a toy gun of the disclosure.
Figure 2:
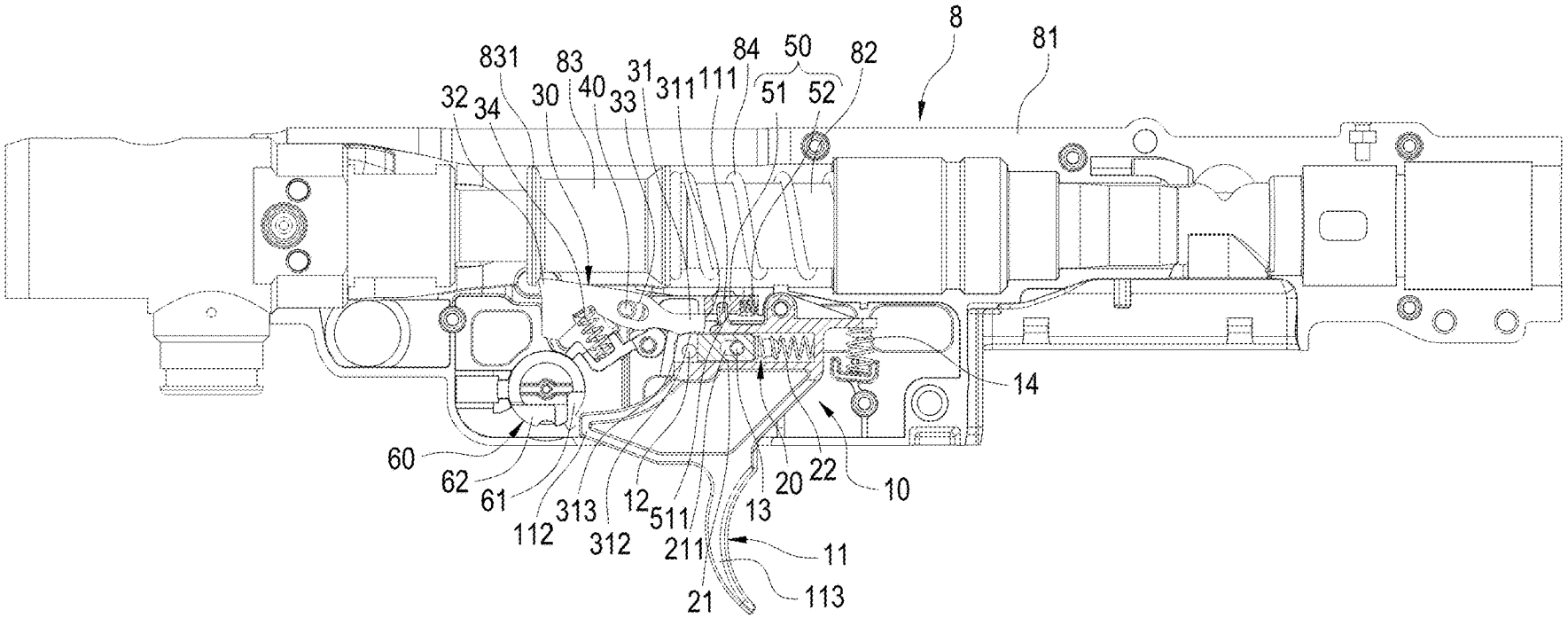
FIG. 2 is a cross-sectional view of the using status of rotating the trigger body in the single-shot mode of the disclosure.

Please refer to FIG. 1. The disclosure provides a single-shot/repeating switching device of a toy gun. The toy gun 8 mainly includes a gun body 81, a barrel 82, a firing cylinder 83, a pressing spring 84 and other related devices and elements. An end of the firing cylinder 83 is formed with a fastening portion 831. The connection and operation of each aforementioned element are related art, so they will not be described herein.

The single-shot/repeating switching device includes a trigger 10, a trigger buffer 20, a release connecting plate 30, a positioning bar 40, a safety blocker 50 and a single-shot/repeating switching button 60.

The trigger 10 includes a trigger body 11, a first shaft 12, a second shaft 13 and a returning spring 14. The trigger body 11 is pivoted to the gun body 81 and has a pushing block 111, an abutting end 112 and a stem 113. A receiving trough 114 is disposed under the pushing block 111 of the trigger body 11. The first shaft 12 passes the trigger body 11 and is located behind the opening of the receiving trough 114. The returning spring 14 is clamped between the gun body 81 and the trigger body 11 which is away from the abutting end 112 so as to make the trigger body 11 able to return the original position when not being continuously rotated.

The trigger buffer 20 is disposed in the receiving trough 114 and mainly includes a moving block 21 and an elastic body 22. A limiting trough 211 is disposed at the middle position of the moving block 21. The second shaft 13 passes the trigger body 11 and the limiting trough 211 and makes the moving block 21 limited in the receiving trough 114. The elastic body 22 is connected to an end of the moving block 21 and elastically pushes the moving block 21. The first shaft 12 is formed on an end of the moving block 21, which is away from the elastic body 22.

The release connecting plate 30 is a strip-shaped plate and has an activating end 31 and a fastened end 32, which are separately located on two ends thereof. The activating end 31 has a front end face 311, a lower arcuate surface 312 and a lower tip 313. The front end face 311 is formed on a front position of the activating end 31. The lower arcuate surface 312 is formed at a lower position of the activating end 31 and connected to the front end face 311. The lower tip 313 is located behind the lower arcuate surface 312 and connected to the lower arcuate surface 312. The lower arcuate surface 312 is between the front end face 311 and the lower tip 313. A sliding trough 33 and a pushing spring 34 are disposed at the middle area of the release connecting plate 30. The sliding trough 33 is between the activating end 31 and the fastened end 32. The pushing spring 34 is disposed between the release connecting plate 30 and the gun body 81 and elastically pushes the release connecting plate 30 to act.

The positioning bar 40 passes the gun body 81 and the sliding trough 33 of the release connecting plate 30 to position the release connecting plate 30 on the gun body 81. The release connecting plate 30 uses the positioning bar 40 to be able to move or sway up, down, left and right relative to the positioning bar 40.

The safety blocker 50 corresponds to the pushing block 111 of the trigger body 11 to be disposed on the gun body 81 and mainly includes a rod 51 and a compression spring 52. The rod 51 has a pushing slope 511. The compression spring 52 is connected to the rod 51 to provide a returning force.

The single-shot/repeating switching button 60 is rotatably connected to the gun body 81 and corresponds to the abutting end 112 of the trigger body 11 to be arranged. The single-shot/repeating switching button 60 has a single-shot opening 61 and a repeating opening 62. The repeating opening 62 is parallel to the central line of the single-shot/repeating switching button 60. The single-shot opening 61 is perpendicular to the central line of the single-shot/repeating switching button 60.

Please refer to FIGS. 2-8. In a single-shot mode, please refer to FIG. 2 first, the single-shot/repeating switching button 60 is rotated to make the single-shot opening 61 directed to the trigger body 11 to be arranged, and the trigger body 11 is pulled to rotate about its pivoting position. At this time, the pushing block 111 of the trigger body 11 pushes along the pushing slope 511 of the rod 51 and makes both the activating end 31 of the release connecting plate 30 and the safety blocker 50 gradually separate.

Figure 3:
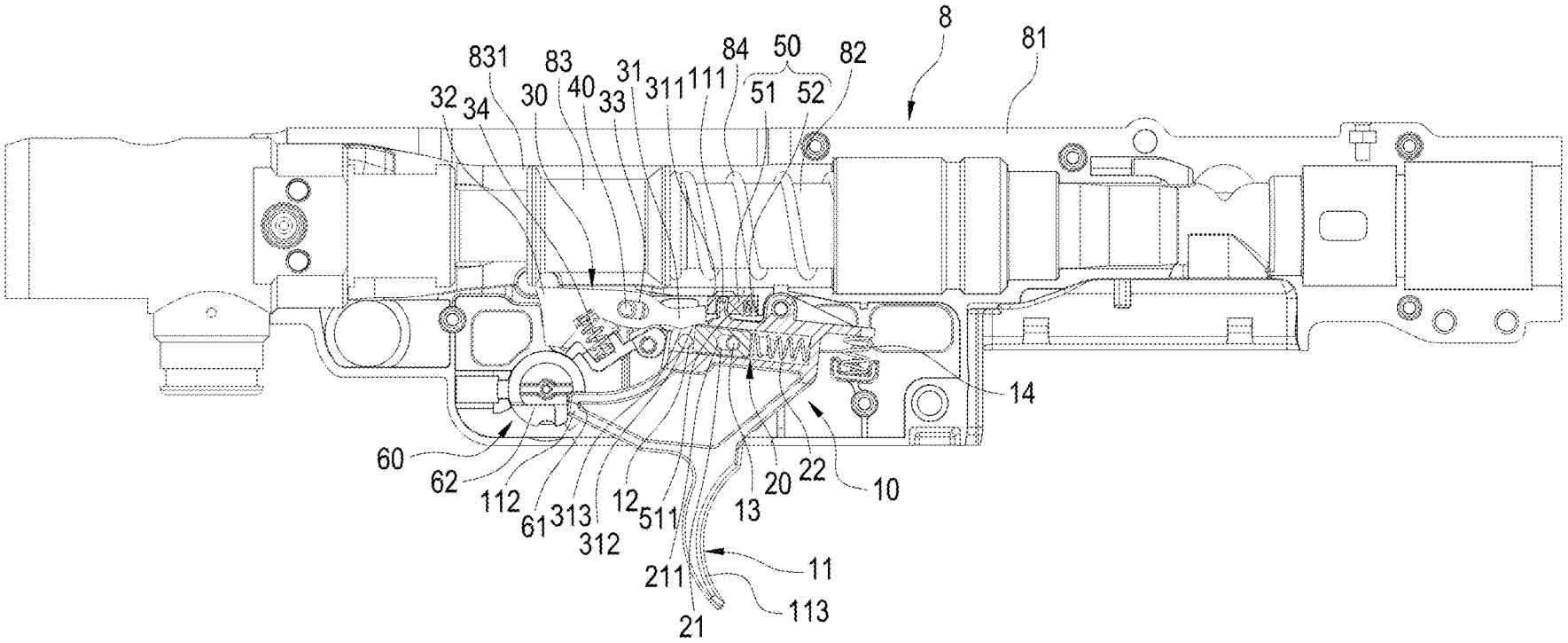
FIG. 3 is a cross-sectional view of the using status of the release connecting plate being upward pushed to the firing cylinder to be ready for escape in the single-shot mode of the disclosure.
Figure 4:
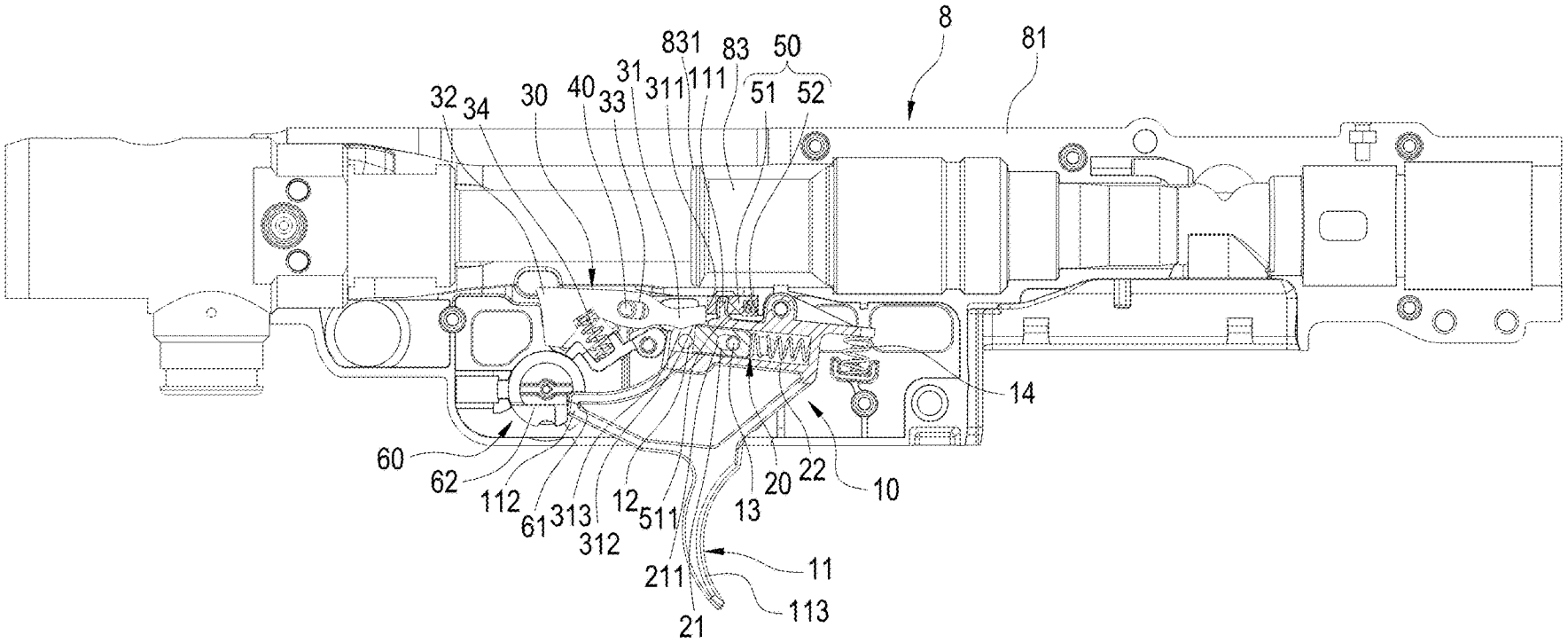
FIG. 4 is a cross-sectional view of the using status of the firing cylinder after firing in the single-shot mode of the disclosure.

Please refer to FIG. 3. After the abutting end 112 of the trigger body 11 enters the single-shot opening 61, the lower arcuate surface 312 of the activating end 31 of the release connecting plate 30 will be pushed by the moving block 21 of the trigger buffer 20. At this time, the release connecting plate 30 will rotate about the positioning bar 40 so as to make the fastening portion 831 of the firing cylinder 83 and the fastened end 32 of the release connecting plate 30 escape from locking. Please refer to FIG. 4. At this time, the firing cylinder 83 will rapidly move along the axial direction of the barrel 82 and eject the inside bullet for firing.

Figure 5:
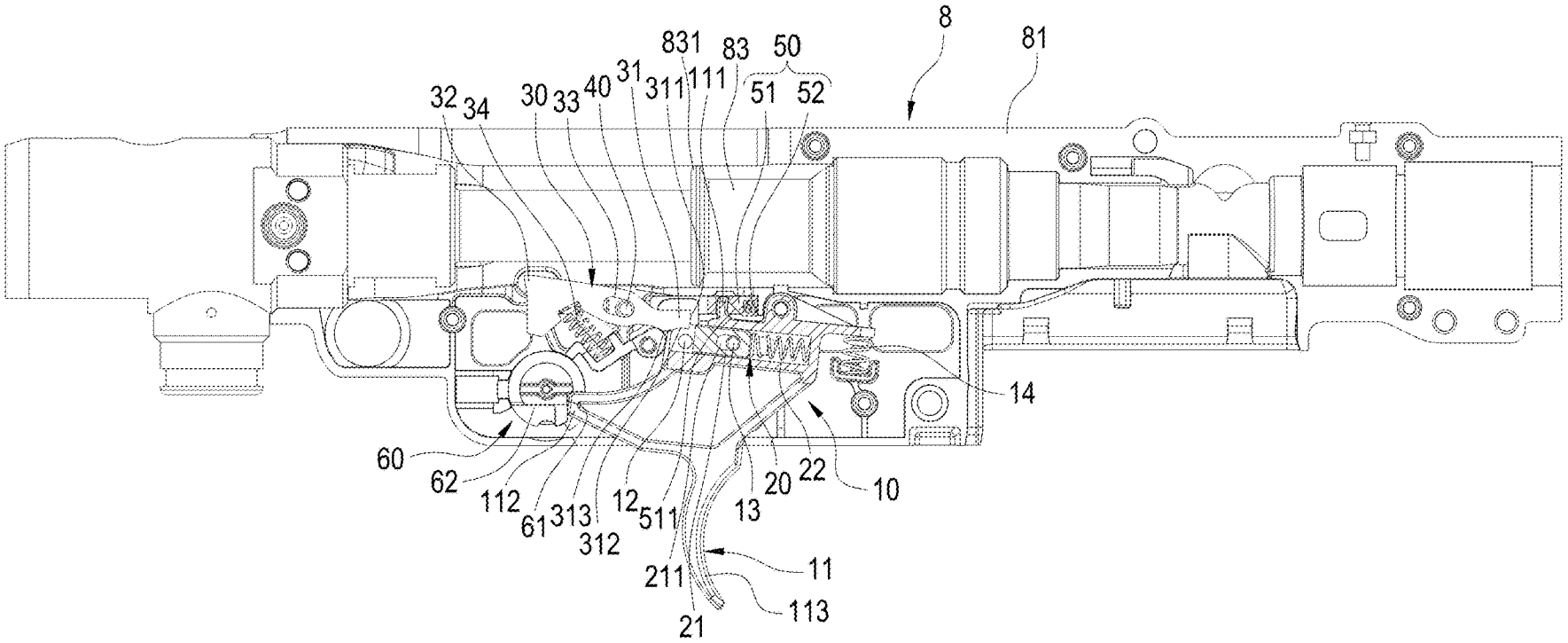
FIG. 5 is a cross-sectional view of the using status of the release connecting plate being upward rearward moved to be ready to be re-hooked by the firing cylinder in the single-shot mode of the disclosure.

Please refer to FIG. 5. After the firing cylinder 83 separates from the release connecting plate 30, the release connecting plate 30 will be elastically pushed by the pushing spring 34 to move rearward and upward to be ready to be re-hooked by the firing cylinder 83. At this time, the positioning bar 40 is just located at the rightmost position of the sliding trough 33 of the release connecting plate 30.

Figure 6:
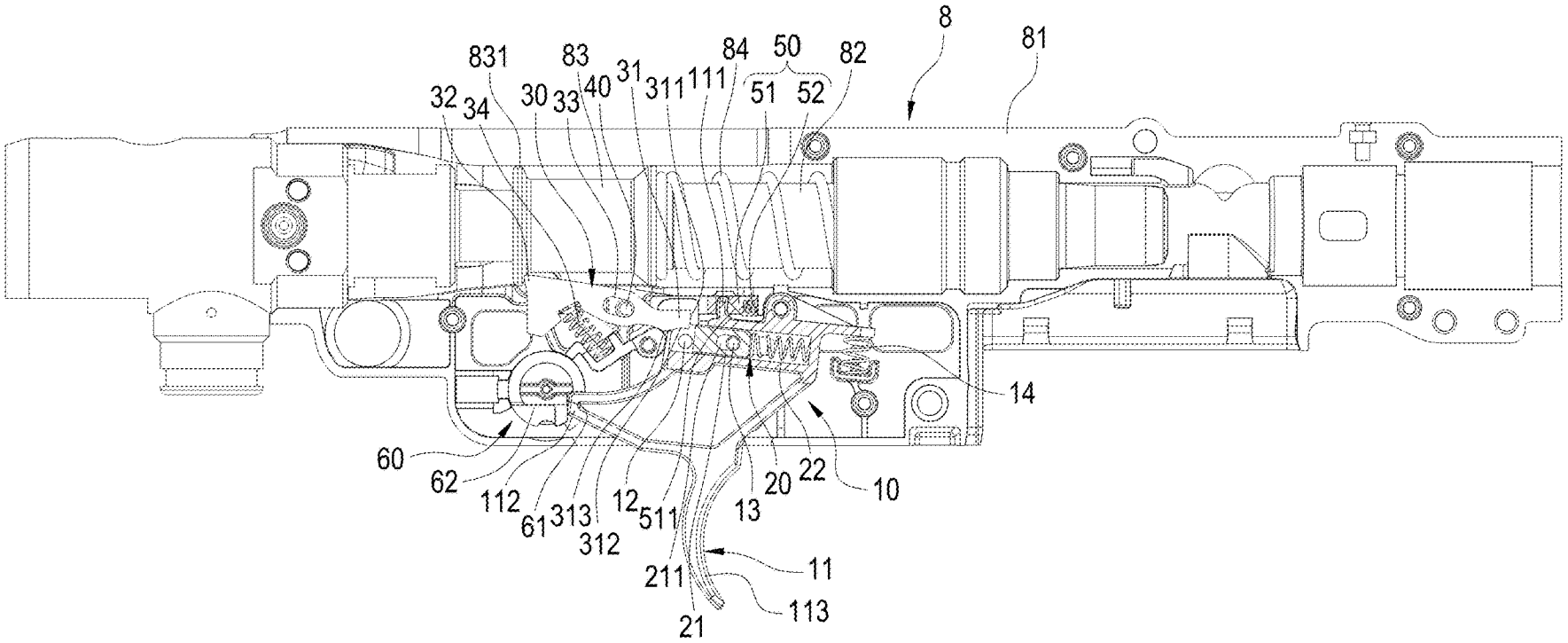
FIG. 6 is a cross-sectional view of the using status of the firing cylinder withdrawing to re-hook the release connecting plate in the single-shot mode of the disclosure after gas ejecting.

Please refer to FIG. 6. After gas is ejected, the firing cylinder 83 is elastically pressed by the pressing spring 84 to be pushed back along the axial direction of the barrel 82. When the firing cylinder 83 passes the fastened end 32 of the release connecting plate 30, the fastening portion 831 of the firing cylinder 83 will re-hook the fastened end 32 of the release connecting plate 30. At this time, the positioning bar 40 is still located at the rightmost position of the sliding trough 33 of the release connecting plate 30.

Figure 7:
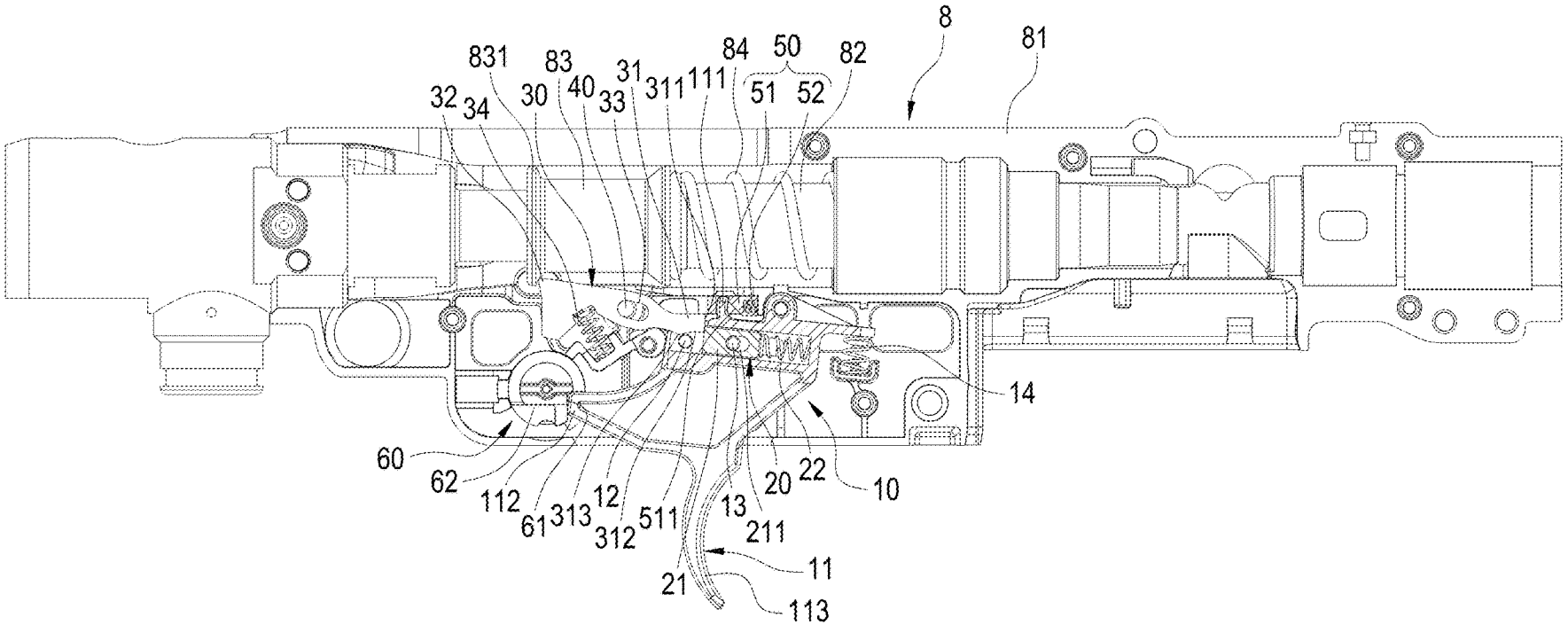
FIG. 7 is a cross-sectional view of the using status of the firing cylinder pushing to the release connecting plate back to the initial position after being gas pressurized in the single-shot mode of the disclosure.

Please refer to FIG. 7. By way of the hooking of the fastening portion 831 of the firing cylinder 83 and the fastened end 32 of the release connecting plate 30, when the firing cylinder 83 is pushed by gas pressure, it will push the release connecting plate 30 to the initial position. At this time, the positioning bar 40 is located at the leftmost position of the sliding trough 33 of the release connecting plate 30.

Figure 8:
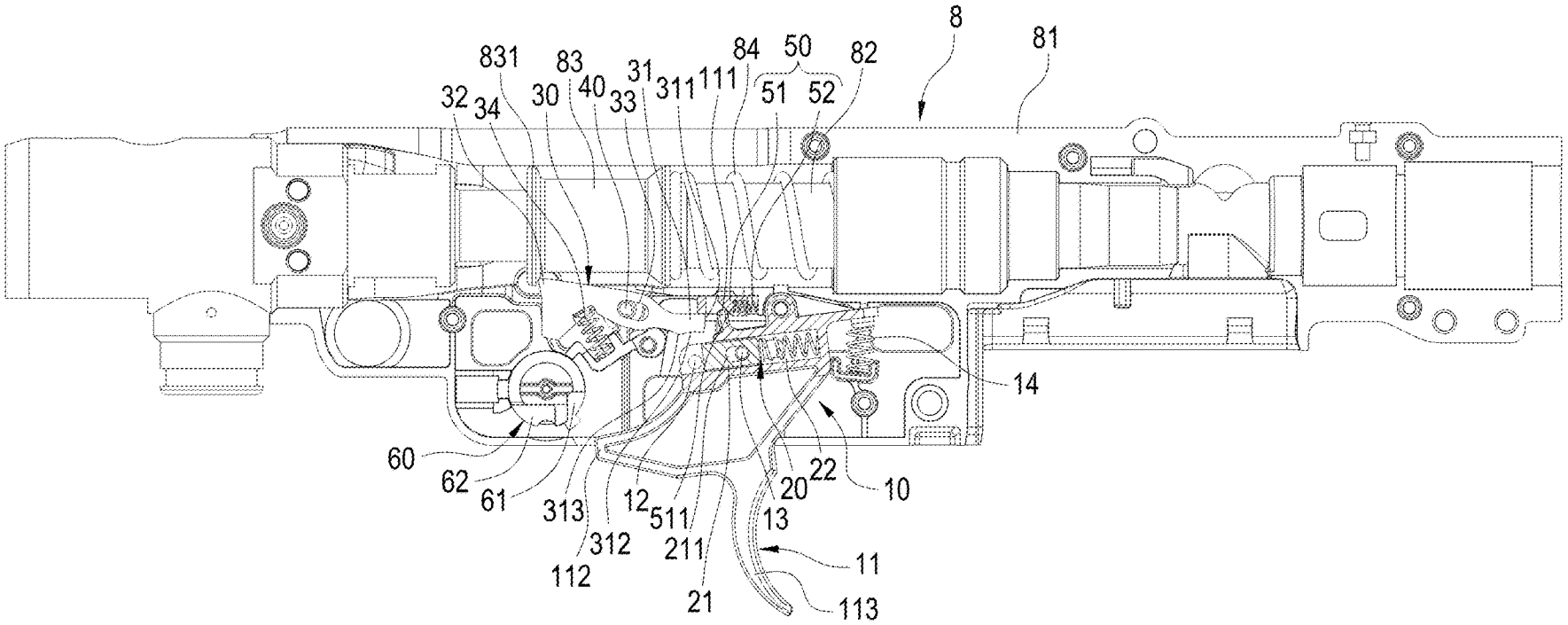
FIG. 8 is a cross-sectional view of the returning of the trigger body in the single-shot mode of the disclosure.
Figure 9:
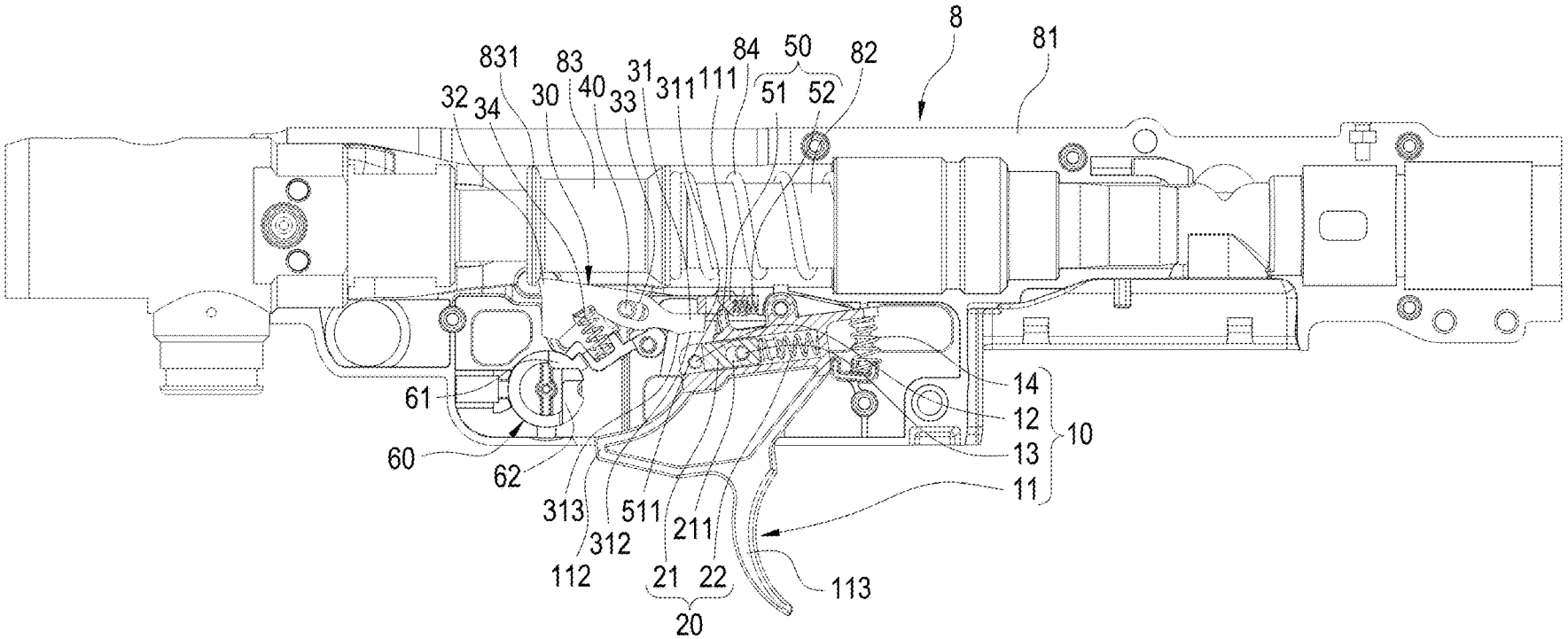
FIG. 9 is a cross-sectional view of the using status of rotating the single-shot/repeating switching button in the repeating mode of the disclosure.

Please refer to FIG. 8. After the trigger body 11 is released, it will restore to the initial position with the pivoting position as a rotation center. At this time, the pushing block 111 of the trigger body 11 will withdraw from the pushing slope 511 of the rod 51.

Please refer to FIGS. 9-17. In a repeating mode, please refer to FIG. 9 first, the single-shot/repeating switching button 60 is rotated to make the repeating opening 62 directed to the trigger body 11 to be arranged. At this time, the rod 51 of the safety blocker 50 stops the activating end 31 of the release connecting plate 30 to present a still status.

Figure 10:
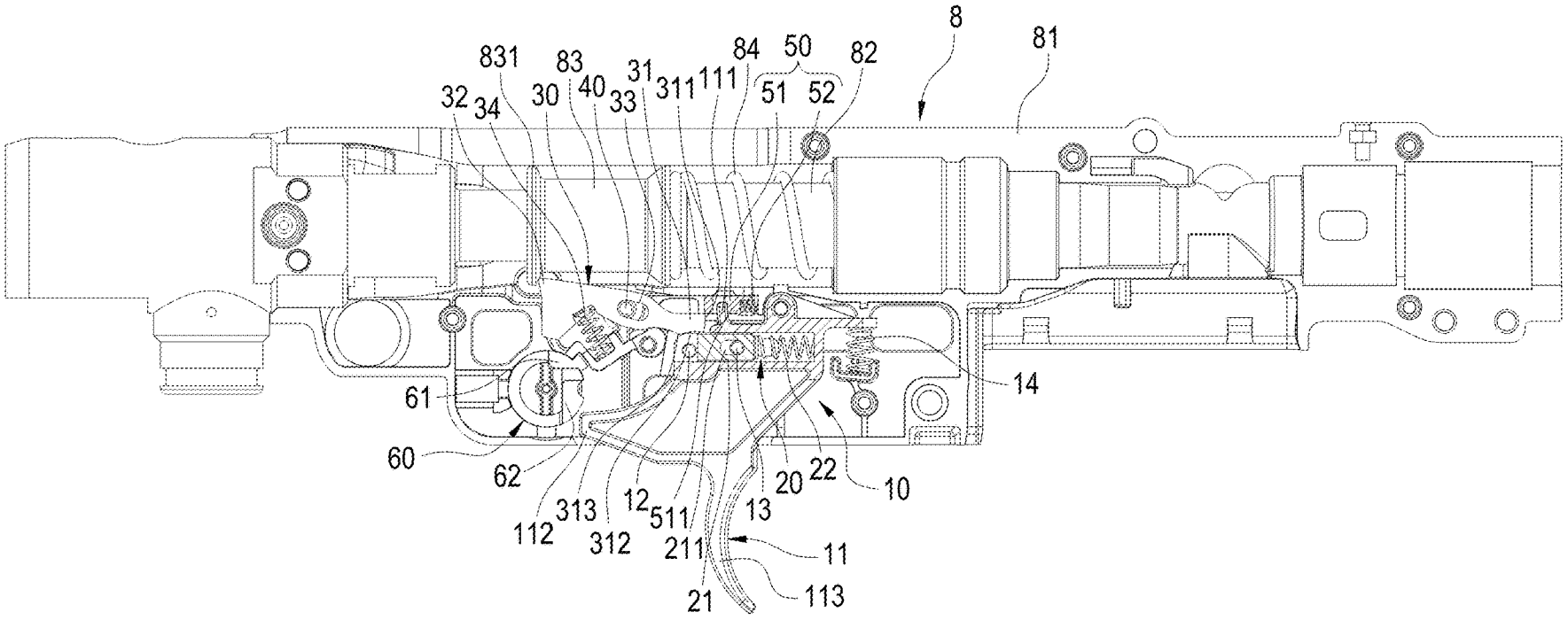
FIG. 10 is a cross-sectional view of the using status of rotating the trigger body in the repeating mode of the disclosure.

Please refer to FIG. 10. The trigger body 11 is pulled to rotate about its pivoting position as a rotation center. At this time, the pushing block 111 of the trigger body 11 will push along the pushing slope 511 of the rod 51 and make the activating end 31 of the release connecting plate 30 and the safety blocker 50 gradually separate.

Figure 11:
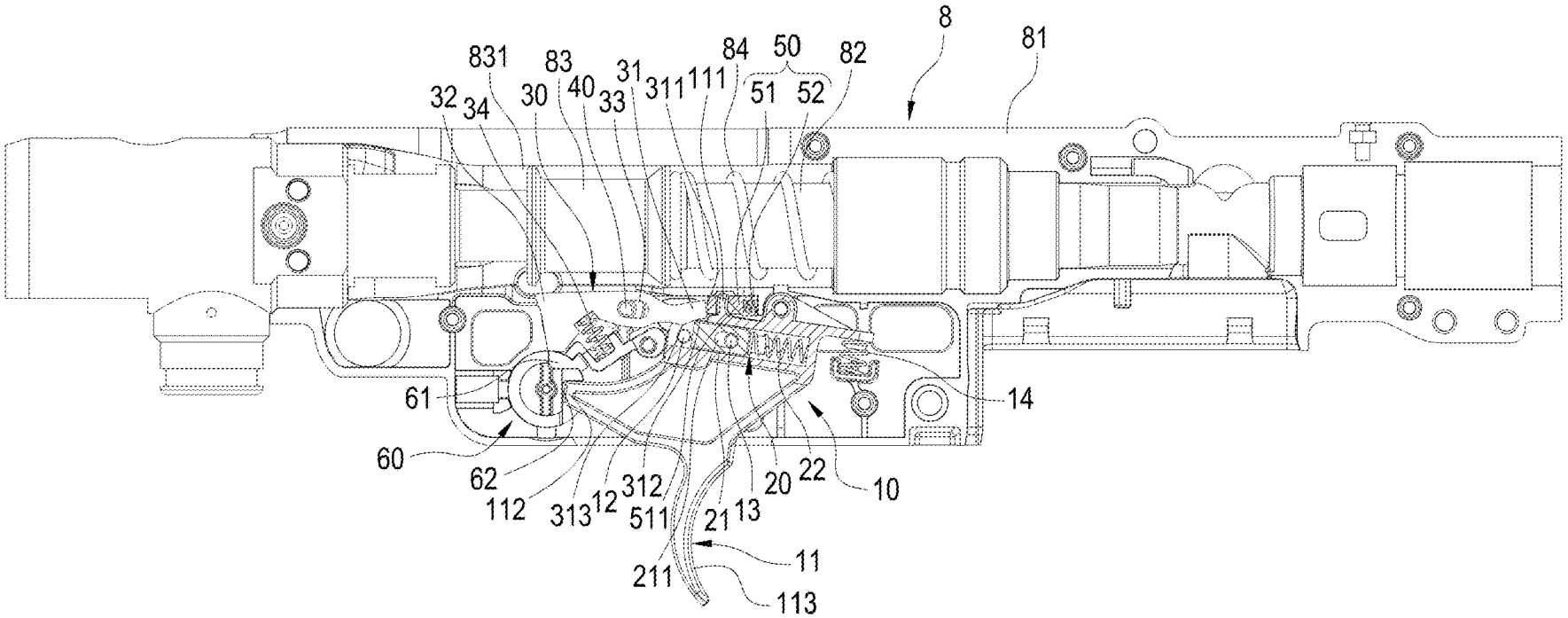
FIG. 11 is a cross-sectional view of the using status of the release connecting plate being upward pushed to the firing cylinder to be ready for escape in the repeating mode of the disclosure.
Figure 12:
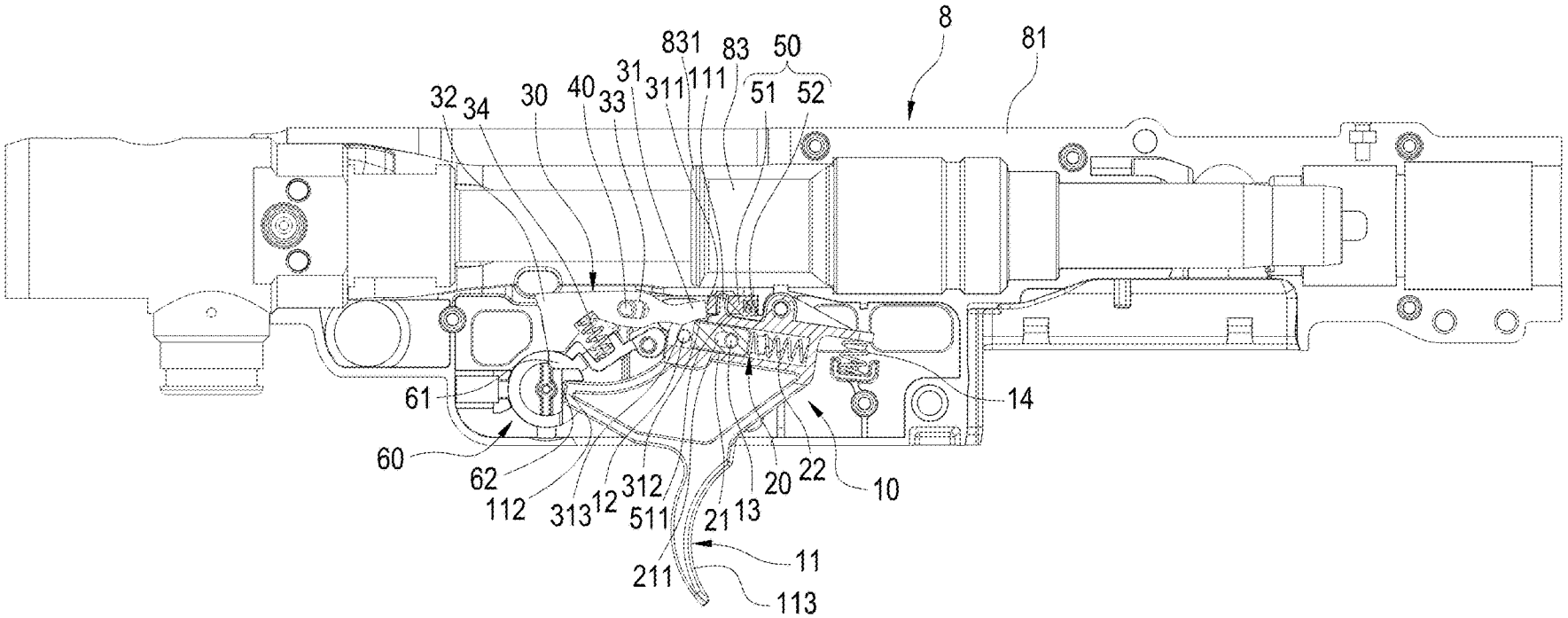
FIG. 12 is a cross-sectional view of the using status of the firing cylinder after firing in the repeating mode of the disclosure.

Please refer to FIG. 11. After the abutting end 112 of the trigger body 11 enters the repeating opening 62, the lower arcuate surface 312 of the activating end 31 of the release connecting plate 30 will be pushed by the moving block 21 of the trigger buffer 20. At this time, the release connecting plate 30 will rotate about the positioning bar 40 as a rotation center to make the fastened end 32 of the release connecting plate 30 and the fastening portion 831 of the firing cylinder 83 escape from locking. Please refer to FIG. 12. At this time, the firing cylinder 83 will rapidly move along the axial direction of the barrel 82 and eject the inside bullet for the first firing.

Figure 13:
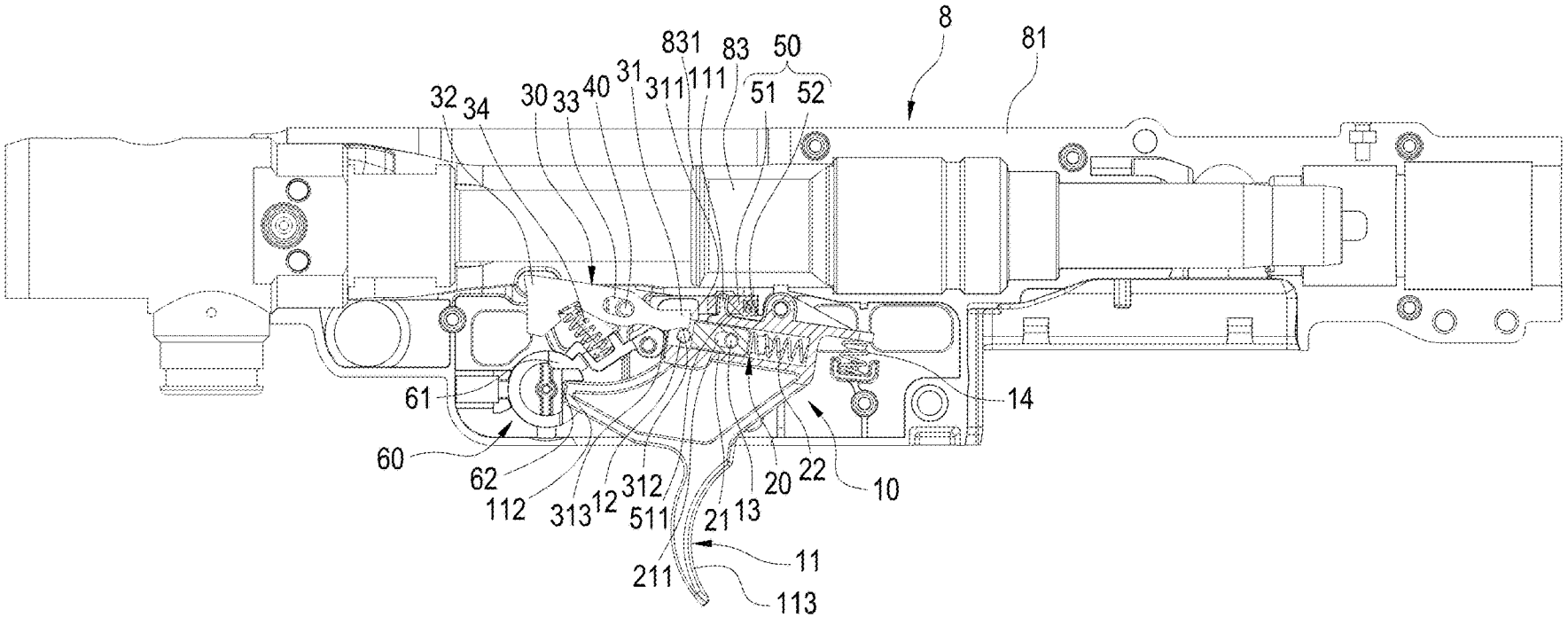
FIG. 13 is a cross-sectional view of the using status of the release connecting plate being upward rearward moved to be ready to be re-hooked by the firing cylinder in the repeating mode of the disclosure.

Please refer to FIG. 13. After the firing cylinder 83 separates from the release connecting plate 30, the release connecting plate 30 will be elastically pushed by the pushing spring 34 to move rearward and upward to be ready to be re-hooked by the firing cylinder 83. At this time, the positioning bar 40 is just located at the rightmost position of the sliding trough 33 of the release connecting plate 30.

Figure 14:
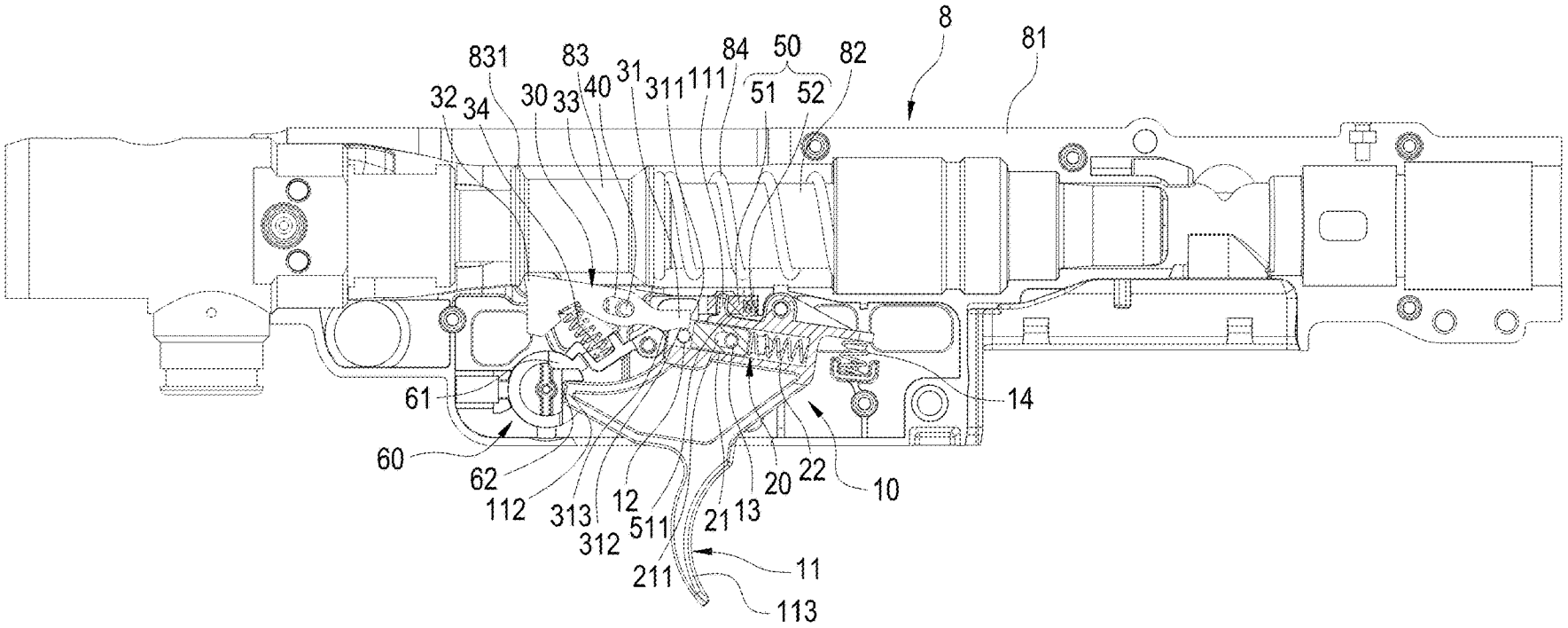
FIG. 14 is a cross-sectional view of the using status of the firing cylinder withdrawing to re-hook the release connecting plate in the repeating mode of the disclosure after gas ejecting.

Please refer to FIG. 14. After gas is ejected, the firing cylinder 83 is elastically pressed by the pressing spring 84 to be pushed back along the axial direction of the barrel 82. When the firing cylinder 83 passes the fastened end 32 of the release connecting plate 30, the fastening portion 831 of the firing cylinder 83 will re-hook the fastened end 32 of the release connecting plate 30. At this time, the positioning bar 40 is still located at the rightmost position of the sliding trough 33 of the release connecting plate 30.

Figure 15:
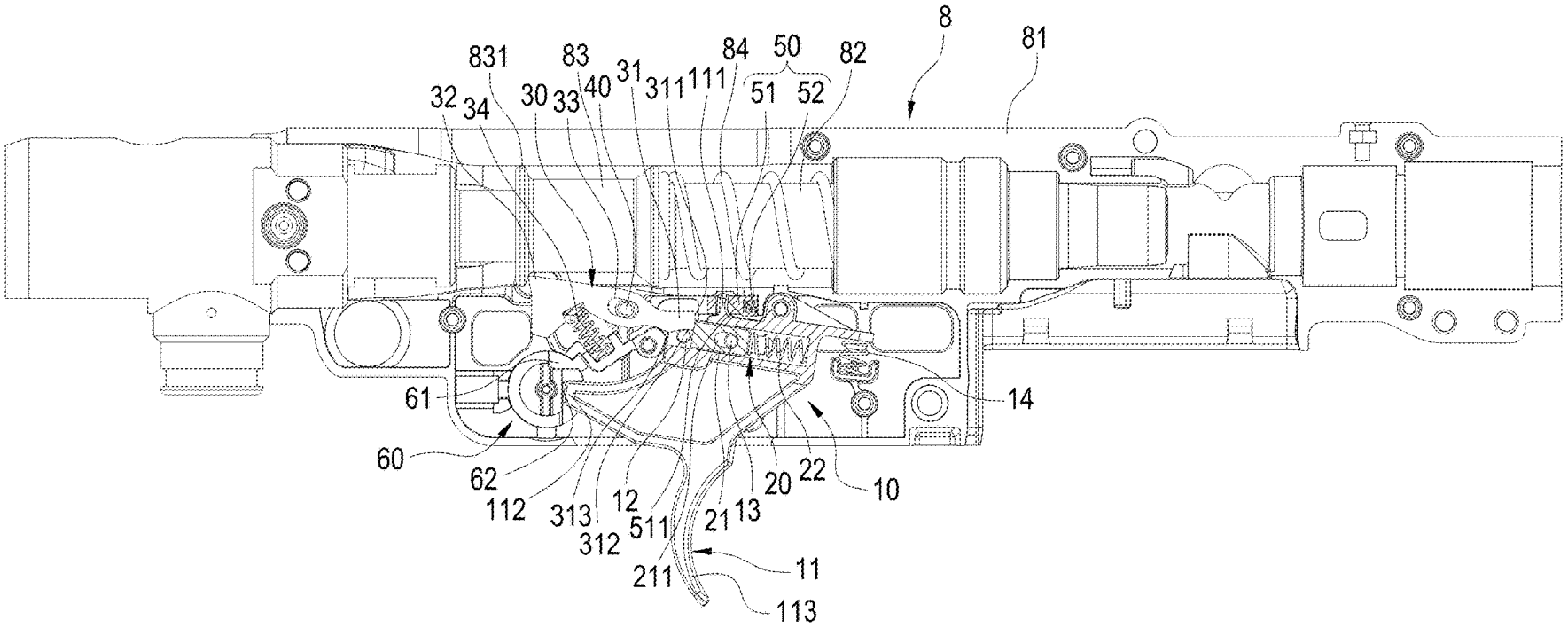
FIG. 15 is a cross-sectional view of the using status of the firing cylinder pushing to the release connecting plate back to the initial position after being gas pressurized in the repeating mode of the disclosure.

Please refer to FIG. 15. By way of the hooking of the fastening portion 831 of the firing cylinder 83 and the fastened end 32 of the release connecting plate 30, when the firing cylinder 83 is pushed by gas pressure, it will push the release connecting plate 30 to move. At this time, the positioning bar 40 does not arrive at the leftmost position of the sliding trough 33 of the release connecting plate 30 yet. Also, because the trigger body 11 in the repeating mode has a larger rotational angle than the repeating mode, the position of the first shaft 12 will be higher so as to make the lower arcuate surface 312 of the activating end 31 of the release connecting plate 30 touch the first shaft 12 and the front end face 311 of the activating end 31 pushed by the moving block 21 of the trigger buffer 20.

Figure 16:
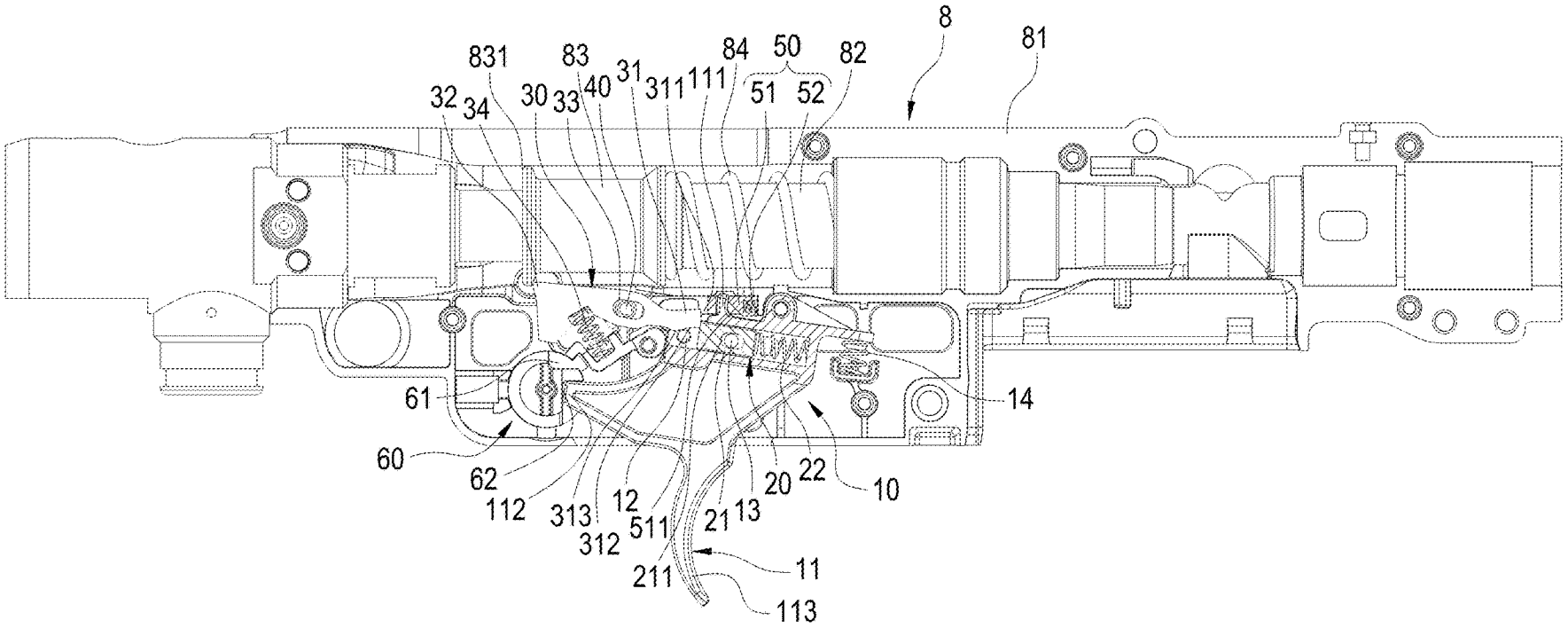
FIG. 16 is a cross-sectional view of the using status of the release connecting plate pushing the trigger buffer to generate a buffering action in the repeating mode of the disclosure.

Please refer to FIG. 16. When the pushing force exerted to the firing cylinder 83 by the gas pressure is greater than the elastic action force exerted to the firing cylinder 83 by the pressing spring 84, the firing cylinder 83 will gradually move toward the front side of the barrel 82. At this time, the lower arcuate surface 312 of the activating end 31 will rotate upward along the center of the first shaft 12 and the positioning bar 40 does not arrive at the leftmost position of the sliding trough 33 of the release connecting plate 30 yet. The front end face 311 of the activating end 31 is pushed by the moving block 21 of the trigger buffer 20 to generate a buffering action so as to reduce the subsequent repeating speed.

Figure 17:
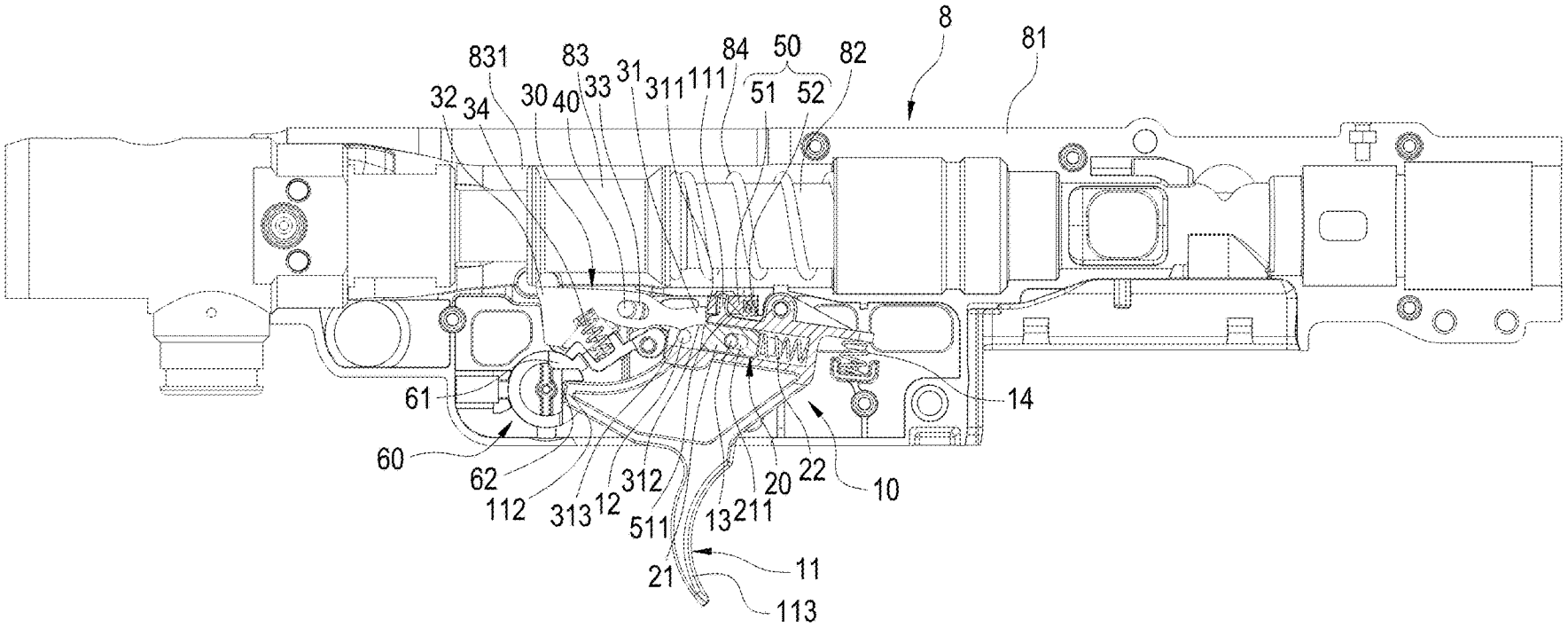
FIG. 17 is a cross-sectional view of the using status of the release connecting plate being forward pushed to touch the first shaft to rotate in the repeating mode of the disclosure.

Please refer to FIG. 17. When the firing cylinder 83 continuously pushes the release connecting plate 30 to move to make the positioning bar 40 arrive at the leftmost position of the sliding trough 33 of the release connecting plate 30, at this time the lower top 313 of the activating end 31 of the release connecting plate 30 touches the first shaft 12, and the front end face 311 of the activating end 31 will move upward to push the lower arcuate surface 312 of the release connecting plate 30 by way of the moving block 21 of the trigger buffer 20. At this time, the firing cylinder 83 will rapidly move along the axial direction of the barrel 82 and eject the inside bullet for the second firing.

While this disclosure has been described by means of specific embodiments, numerous modifications and variations could be made thereto by those skilled in the art without departing from the scope and spirit of this disclosure set forth in the claims.

What is claimed is:

1. A single-shot/repeating switching device of a toy gun, wherein the toy gun comprises a gun body and a firing cylinder, the single-shot/repeating switching device comprising:

a trigger, comprising a trigger body, and the trigger body being pivoted to the gun body and comprising a pushing block and an abutting end;

a trigger buffer, disposed on the trigger body, and comprising a moving block and an elastic body pushing the moving block;

a release connecting plate, comprising an activating end, a fastened end and a sliding trough between the activating end and the fastened end;

a positioning bar, passing the gun body and the sliding trough to position the release connecting plate;

a safety blocker, corresponding to the pushing block to be disposed on the gun body; and a single-shot/repeating switching button, rotatably connected to the gun body, and comprising a repeating opening;

wherein in a repeating mode, the trigger body is moved to make the abutting end enter the repeating opening, the pushing block pushes the safety blocker to move, the moving block pushes the activating end of the release connecting plate to move upward to make the fastened end escape from locking of the firing cylinder to generate a first firing, the firing cylinder touches the fastened end to make the release connecting plate rotate about the positioning bar during a return process of the firing cylinder, and the activating end is pressed by the trigger buffer to slow down a subsequent repeating speed.

2. The single-shot/repeating switching device of the toy gun of claim 1, wherein the activating end of the release connecting plate comprises a front end face, a lower arcuate surface and a lower tip, the front end face is formed on a front position of the activating end, the lower arcuate surface and the lower tip are formed at a lower position of the activating end, and the lower arcuate surface is between the front end face and the lower tip.

3. The single-shot/repeating switching device of the toy gun of claim 2, further comprising a pushing spring, wherein the pushing spring is disposed between the release connecting plate and the gun body and elastically pushes the release connecting plate to act.

4. The single-shot/repeating switching device of the toy gun of claim 1, wherein the sliding trough of the release connecting plate is between the activating end and the fastened end.

5. The single-shot/repeating switching device of the toy gun of claim 1, wherein the trigger body is disposed with a receiving trough, and the trigger buffer is disposed in the receiving trough.

6. The single-shot/repeating switching device of the toy gun of claim 5, wherein the trigger further comprises a first shaft, the first shaft is connected to the trigger body and formed on an end of the moving block, which is away from the elastic body.

7. The single-shot/repeating switching device of the toy gun of claim 6, wherein the trigger further comprises a second shaft, the moving block is disposed with a limiting trough, and the second shaft passes the trigger body and the limiting trough to make a travel of the moving block limited by the second shaft.

8. The single-shot/repeating switching device of the toy gun of claim 1, wherein the trigger further comprises a returning spring, and the returning spring is clamped between the gun body and the trigger body which is away from the abutting end.

9. The single-shot/repeating switching device of the toy gun of claim 1, wherein the safety blocker comprises a rod and a compression spring, the rod comprises a pushing slope pushed by the pushing block, and the compression spring is connected to the rod to provide a returning force.

10. The single-shot/repeating switching device of the toy gun of claim 1, wherein the single-shot/repeating switching button is further disposed with a single-shot opening, the repeating opening is parallel to a central line of the single-shot/repeating switching button, and the single-shot opening is perpendicular to the central line of the single-shot/repeating switching button.

* * * * *